US005129764A

United States Patent [19]

Casagrande

[11] Patent Number: 5,129,764

[45] Date of Patent: Jul. 14, 1992

[54] DEVICE TO FEED REINFORCEMENT RODS

[75] Inventor: Bruno Casagrande, Fontanafredda, Italy

[73] Assignee: Casagrande SpA, Fontanafredda, Italy

[21] Appl. No.: 595,363

[22] Filed: Oct. 10, 1990

[30] Foreign Application Priority Data

Oct. 26, 1989 [IT] Italy ..... 83494 A/89

[51] Int. Cl.[5] ..... E21D 19/00

[52] U.S. Cl. ..... 405/303; 405/140; 405/145

[58] Field of Search ..... 405/303, 259, 146, 150, 405/151, 40, 45; 173/22, 23, 42, 43, 39, 46

[56] References Cited

U.S. PATENT DOCUMENTS 4,095,434 6/1978 Hunter et al. ..... 405/150
4,264,051 4/1981 Walmsley et al. ..... 173/43 X
4,799,556 1/1989 Foster et al. ..... 173/43

FOREIGN PATENT DOCUMENTS 382428 2/1987 Fed. Rep. of Germany .
3610814A1 10/1987 Fed. Rep. of Germany .

*Primary Examiner*—Dennis L. Taylor
*Attorney, Agent, or Firm*—Nixon & Vanderhye

[57] ABSTRACT

Device (26) to feed reinforcement rods (25), which is suitable to cooperate with an excavation equipment (14) in providing lengthwise reinforcements in tunnels, particularly in excavations of a great depth amounting to about twenty meters or more, the excavation equipment (14) being borne on an excavator machine (10) and being able to rotate by an angle "alpha" from one or the other of two lateral inactive positions (A-B), the device (26) comprising means (27) for connection to the excavation equipment (14), support means (28) that bear means (30) that uphold and lift the reinforcement rods (25), means (32), that draw the reinforcement rods (25) and means (34–35) that guide and align the reinforcement rods (25).

6 Claims, 3 Drawing Sheets

DEVICE TO FEED REINFORCEMENT RODS

BACKGROUND OF THE INVENTION

1. Field of the Invention

This invention concerns a device to feed reinforcement rods. To be more exact, this invention concerns a device suitable to cooperate with an excavation equipment in providing that excavation equipment with non-recoverable reinforcement rods employed in the lengthwise reinforcing of tunnels.

2. Discussion of Prior Art

The device of the invention and the excavation equipment are normally borne on an excavation machine working at the excavation site.

The state of the art covers various methods and devices employed in the reinforcement of tunnels.

One of the systems used most often consists in making a series of lengthwise holes about the vault of the tunnel.

At the end of each drilling step, which is carried out with suitable tools on a shaft, the shaft is withdrawn from the hole drilled in the wall and a cement agglomerate is injected into the hole.

Thereafter a non-recoverable reinforcement rod having a length substantially the same as that of the hole thus made is inserted into the cement agglomerate to complete the reinforcement.

The cycle is repeated at each hole drilled and therefore there is a continuous handling of the drilling shaft alternated from time to time with the feed of new rods to be inserted into the holes made in the wall.

The drilling and the insertion of the reinforcement rods are normally carried out by the same excavation equipment, which is borne on an operating machine.

The operating machine brings the excavation equipment, provided with the drilling shaft, from time to time to the hole to be drilled.

As each hole is completed, the excavation equipment is normally moved to one of its two lower positions at the sides of the excavation machine, where the drilling shaft is removed and the reinforcement rod to be inserted is fitted by hand.

The drilling equipment is then brought back to the hole previously made and filled with cement agglomerate in the meantime.

During these working steps the engagement of the reinforcement rods, which are usually deposited on the ground near the excavation machine, and the lifting of the rods for their positioning on the excavation equipment are especially burdensome. These operations are even more burdensome when it is realized that these rods may even be 20–22 meters long or more.

SUMMARY OF THE INVENTION

The present applicant has as his objective a device able to overcome the problems of lifting and positioning the reinforcement rods on the excavation equipment.

The invention is set forth in the main claim, while the dependent claims describe various features of the invention.

The device to feed reinforcement rods according to the invention is secured advantageously to a rear terminal portion of the excavation equipment at its part farthest from the excavation face.

The device comprises means suitable to support and lift from the ground each reinforcement rod, including means to draw the rods so as to position them suitably on the excavation equipment.

For this purpose the device of the invention comprises also means to align and guide the rods while the latter are being positioned on the excavation equipment.

The device of the invention is suitable to cooperate advantageously with a reinforcement rod loader included on the excavation equipment and with an excavation machine, the loader and the machine being the subject of parallel patent applications in the name of the present applicant.

These and other special features of the invention will be made clear in the description that follows.

BRIEF DESCRIPTION OF THE DRAWINGS

The attached figures, which are given as a non-restrictive example, show the following.

DETAILED DESCRIPTION OF PREFERRED EMBODIMENTS

Figure 1:
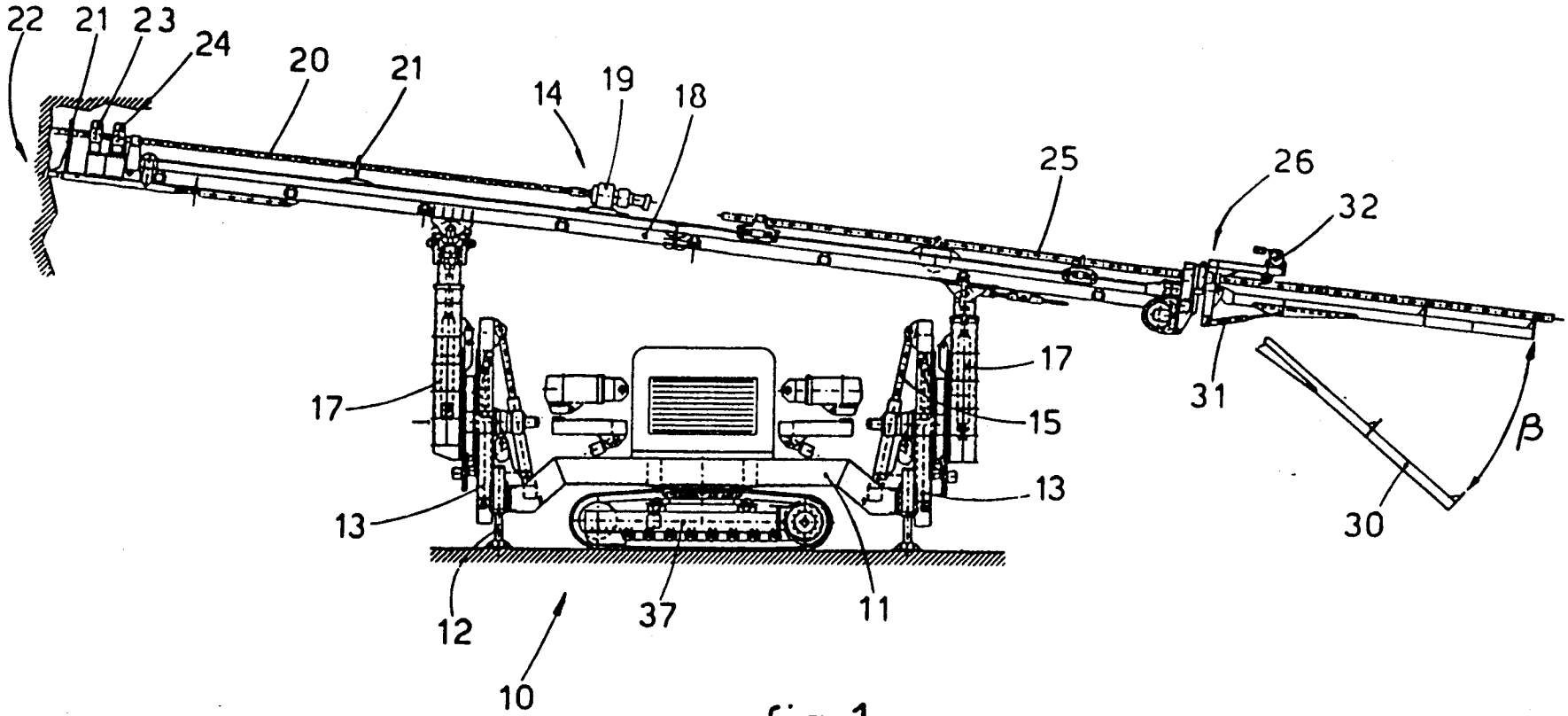
FIG. 1 is a side view of an operating machine of a type which is the subject of a parallel patent application of the present applicant and which bears an excavation equipment with a device according to the invention.
Figure 2:
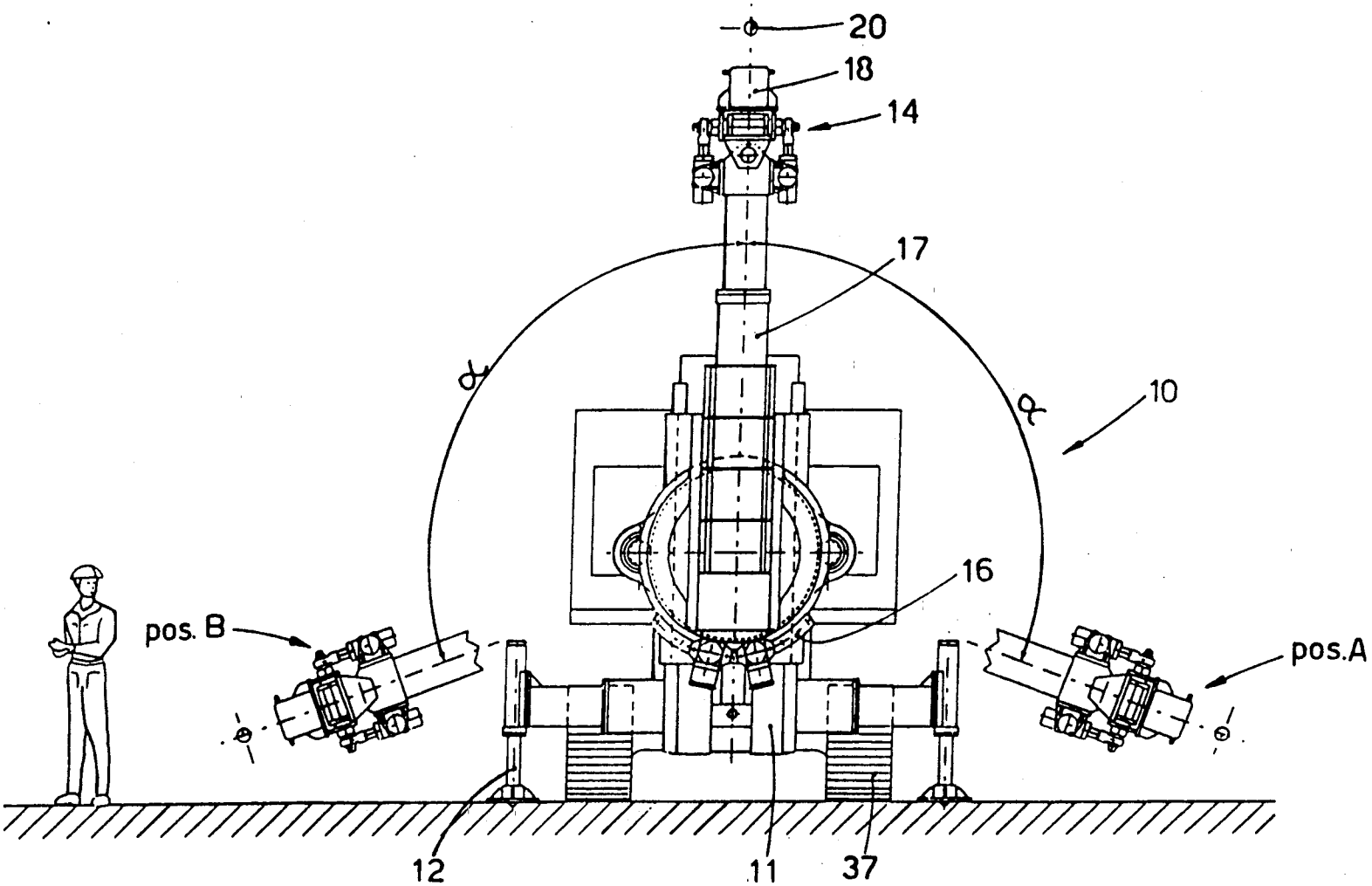
FIG. 2 is an enlarged front view of the machine of FIG. 1.

In FIGS. 1 and 2 a machine 10 to carry out lengthwise reinforcements in tunnels consists, in this example, of a tracked vehicle 37 equipped with a turret 11, which can be actuated to rotate continuously by 360° and is provided with stabilizers 12 for level positioning.

A pair of structures 13 to support an excavation equipment 14 are hinged on the turret.

These support structures 13, which during movements of the vehicle 37 are folded into the overall profile of the vehicle 37 by jacks 15, comprise rotation thrust bearings 16 connected to telescopic columns 17.

The columns 17 bear at their ends the excavation equipment 14 and by means of the rotation thrust bearings 16 can travel through an angle "alpha" (see FIG. 2) in relation to the vertical so as to cover the whole field of drilling.

The lowest positions A and B of the equipment 14 are those in which any work on the apparatus and drilling materials is carried out advantageously.

The excavation equipment 14 consists of a support 18 for a drilling head 19 able to run along the support 18.

The drilling head 19 is equipped in a known manner to actuate a drilling shaft 20 that cooperates with alignment guides 21 suitable to hold and align the shaft 20 on the drilling head 19.

At the end of the excavation equipment 14 on the side nearest to the excavation face 22 there are also comprised a first vice 23 to clamp the drilling shaft 20 or reinforcement rod 25 and a second vice 24 for the unscrewing of the drilling shaft 20.

Thus far we have described the operating machine 10, as specified beforehand, and the state of the art.

A device 26 to feed reinforcement rods 25 according to the invention is included at the end of the excavation equipment 14 farthest from the excavation face 22 and is secured to the excavation equipment 14.

The device 26 of the invention is suitable, when it is located with the excavation equipment 14 in position A or B of FIG. 2, to grip a reinforcement rod 25 placed beforehand on the ground behind the tracked vehicle 37.

The device 26 then lifts the reinforcement rod 25 to the height of the excavation equipment 14 and thrusts it progressively forwards along the whole length of the excavation equipment 14 so as to position it suitably until the rod 25 is to be used.

The device 26 cooperates advantageously with a means that loads the reinforcement rods 25 automatically.

The device 26 to feed reinforcement rods 25 consists of a frame 28 connected to the excavation equipment 14 by a suitable structure 27.

An arm 30 is hinged on the frame 28 at the pivot 29 and is suitable to support the rod 25 and to lift it from the ground; the arm 30 is actuated by a jack 31 so as to rotate by an angle "beta" (see FIG. 1).

A lifting means 32 is also connected to the frame 28 and cooperates with the arm 30 by means of a cable or chain or rope 33 in lifting the reinforcement rod 25 from the ground and moving it towards the excavation equipment 14.

Figure 4:
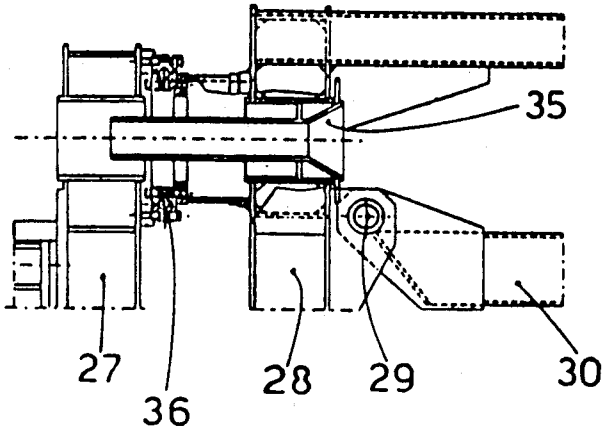
FIG. 4 is an enlarged side view of the details of FIG. 3.
Figure 3:
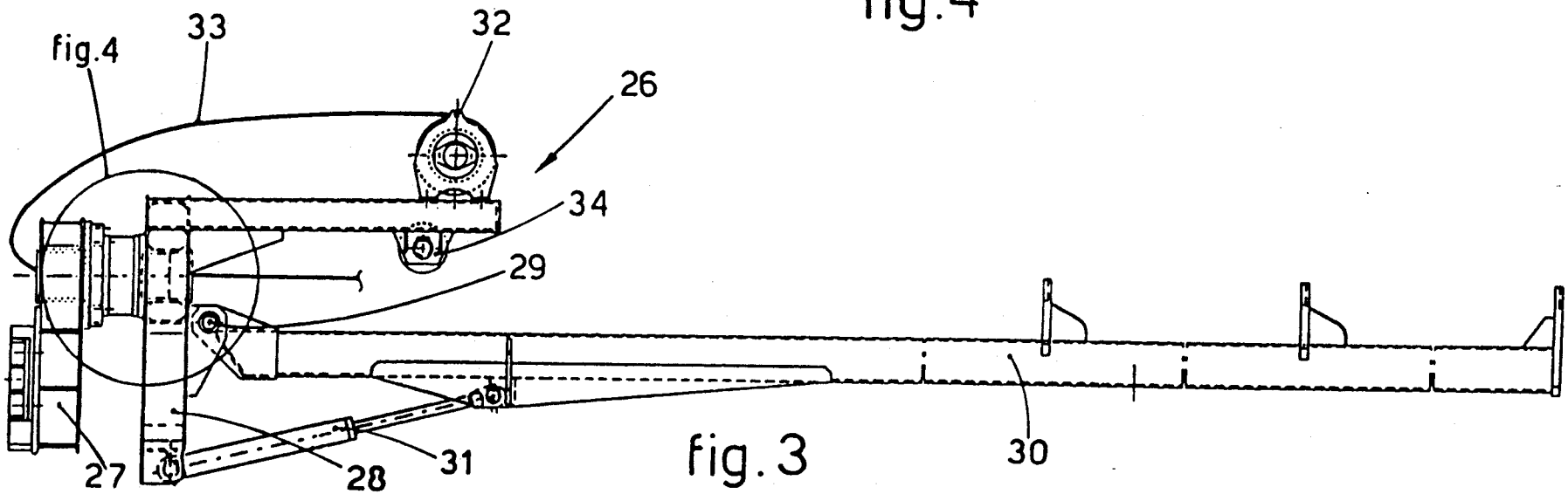
FIG. 3 is a side view of the device of the invention of FIG. 1.

The frame 28 comprises for this purpose a transmission roller 34 and a guide funnel 35 (see FIG. 4), both of which have the task of aligning and guiding the reinforcement rod 25. The cable 33 is passed through the funnel 35.

The reinforcement rod 25 is then brought to a required position on the excavation equipment 14, for instance in correspondence with the drilling head 19, which can slide forward and position the reinforcement rod 25 in turn in correspondence with an automatic loader of reinforcement rods, as we said earlier.

The inclusion of a thrust bearing 36 ensures the vertical positioning of the device 26, irrespective of the position of the excavation equipment 14 on the profile of the tunnel.

According to a variant the lifting means 32 is positioned at the excavation-face end of the excavation equipment 14.

I claim:

1. A device for feeding reinforcing rods to excavation equipment, said excavation equipment having a guide and support element (18) where such excavation equipment utilizes drilling equipment to drill holes along a drilling axis and reinforcing rods are inserted into said holes to provide lengthwise reinforcements in tunnels, where said tunnels include an excavation face and said reinforcing rods extend to a length of about twenty meters, and said excavation equipment is borne on an excavation machine, said device comprising:

fixture means (27) for locating and attaching said device at a terminal portion of said guide and support element (18) away from said excavation face;

a means for supporting and lifting said reinforcing rod from a floor of said tunnel to an initial engagement position near said guide and support element (18); and means for aligning and guiding said rods into position on said excavation equipment (14), said means for aligning and guiding comprising an arm (30) movable with said reinforcing rod from said initial engagement position to a position substantially aligned with a guide and support element (18) on said excavation equipment (14).

2. The apparatus in accordance with claim 1, wherein said means for aligning and guiding further including:

a frame (28) connected to said fixture means (27); and a footstep bearing (36) connected to said frame rotatably mounting said arm (30) on said frame, said bearing comprising a means for permitting said arm to be positioned adjacent said frame.

3. The apparatus in accordance with claim 2, wherein said frame (28) includes a guide funnel (35), said guide funnel having a guide axis coincident with said drilling axis.

4. The apparatus in accordance with claim 3, wherein said means for supporting and lifting includes a lifting means (32) for moving said reinforcing rod into said initial engagement position, said lifting means comprising:

one of a cable and chain (33), said one of said cable and said chain extending through said guide funnel (35), said cable and said chain attachable to said reinforcing rod; and a means for retracting said one of said cable and said chain through said guide funnel.

5. The apparatus in accordance with claim 3, wherein said means for aligning and guiding further includes a transmission roller (34) located facing an upper portion of said arm (30) for aiding in guiding said reinforcing rod into position substantially aligned with said guide and support element (18).

6. The apparatus in accordance with claim 1, wherein said means for aligning and guiding includes jack means (31) for moving said arm (30) such that said reinforcement rod is substantially aligned with said guide and support element (18).

* * * * *